US007434552B2

(12) United States Patent
Gaessler et al.

(10) Patent No.: US 7,434,552 B2
(45) Date of Patent: Oct. 14, 2008

(54) METHOD FOR CONTROLLING AND/OR REGULATING A CONSTANT VOLTAGE CONVERTER FOR AT LEAST TWO ELECTROMAGNETIC VALVES OF AN INTERNAL COMBUSTION ENGINE, ESPECIALLY AN INTERNAL COMBUSTION ENGINE IN A MOTOR VEHICLE

(75) Inventors: Hermann Gaessler, Vaihingen (DE); Ulf Pischke, Stuttgart (DE); Hubert Schweiggart, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 345 days.

(21) Appl. No.: 10/523,254

(22) PCT Filed: Jun. 18, 2003

(86) PCT No.: PCT/DE03/02040

§ 371 (c)(1),
(2), (4) Date: Aug. 17, 2005

(87) PCT Pub. No.: WO2004/016926

PCT Pub. Date: Feb. 26, 2004

(65) Prior Publication Data

US 2006/0124088 A1 Jun. 15, 2006

(30) Foreign Application Priority Data

Jul. 26, 2002 (DE) ..... 102 34 098

(51) Int. Cl.
*F01L 9/04* (2006.01)

(52) U.S. Cl. ..... 123/90.11; 123/90.15

(58) Field of Classification Search ..... 123/90.11, 123/90.15; 251/129.01
See application file for complete search history.

(56) References Cited

U.S. PATENT DOCUMENTS

| | | | | |
|---|---|---|---|---|
| 4,576,135 | A | 3/1986 | Johnson | |
| 5,499,157 | A | 3/1996 | Younessi et al. | |
| 5,555,165 | A | 9/1996 | Vinciarelli | |
| 5,915,347 | A * | 6/1999 | Yanai et al. | 123/90.11 |
| 6,158,403 | A | 12/2000 | Sharples et al. | |

FOREIGN PATENT DOCUMENTS

| | | | |
|---|---|---|---|
| JP | 60162025 | * | 8/1985 |
| JP | 4233706 | * | 8/1992 |
| JP | 6288243 | * | 10/1994 |

* cited by examiner

*Primary Examiner*—Zelalem Eshete
(74) *Attorney, Agent, or Firm*—Kenyon & Kenyon LLP

(57) ABSTRACT

A method for controlling and/or regulating a d.c. converter for at least two electromagnetic valves of an internal combustion engine of a motor vehicle is provided. A current generated by the d.c. converter is supplied to each valve. A determination is made as to when the total currents supplied to the valves constitute a high load for the d.c. converter. If this is the case, the d.c. converter is influenced in the sense of better processing of the high load.

9 Claims, 3 Drawing Sheets t
t
t
22
23
24
25
26
27
T1
T2
T
$I_B$
S
$U_B$
$U_{Bsetpoint}$

METHOD FOR CONTROLLING AND/OR REGULATING A CONSTANT VOLTAGE CONVERTER FOR AT LEAST TWO ELECTROMAGNETIC VALVES OF AN INTERNAL COMBUSTION ENGINE, ESPECIALLY AN INTERNAL COMBUSTION ENGINE IN A MOTOR VEHICLE

FIELD OF THE INVENTION

The present invention is directed to a method for controlling and/or regulating a d.c. converter for at least two electromagnetic valves of an internal combustion engine in which each valve is supplied with a current generated by the d.c. converter. The present invention also relates to a corresponding device for controlling and/or regulating a d.c. converter for at least two electromagnetic valves.

BACKGROUND INFORMATION

It is known that a plurality of electromagnetic valves may be supplied with current by a d.c. converter via an output stage. In this context, it is possible for overlapping currents for the different valves to result in a high load for the d.c. converter as a whole. The d.c. converter must be designed for this high load, which is associated with increased expenditure under some circumstances.

SUMMARY OF THE INVENTION

The object of the present invention is to provide a method in which the expenditure for processing a high load of the d.c. converter is reduced.

This object is achieved with the method according to the present invention by determining when the total currents supplied to the valves represent a high load for the d.c. converter, and if this is the case, by adapting the d.c. converter for improved processing of the high load. The present invention also provides a corresponding device.

The d.c. converter is set to the high load using the present invention. Thus, the d.c. converter is capable of better processing this high load. This in turn entails the advantage that the d.c. converter need no longer be designed on the basis of the high load but instead may be designed by taking into account the better processing according to the present invention. In particular, it is possible to select the output capacitor of the d.c. converter to be smaller than would be necessary to match a high load.

In an advantageous further refinement of the present invention, the output voltage of the d.c. converter is increased when there is a high load. The output voltage may be controlled and/or regulated to a setpoint value and the n setpoint value may be increased.

This measure achieves the result that the high load of the d.c. converter results in a lower dip in the output voltage. In particular, as already mentioned, the smaller dip in the output voltage allows a smaller output capacitor of the d.c. converter to be used.

It is particularly advantageous if the increase in the output voltage and/or the setpoint value is already performed before the high load occurs. Thus the d.c. converter is prepared for the high load. In this case, the output voltage already increases to the full extent when the high load occurs and is thus effective.

A further implementation of the present invention includes a computer program having program commands suitable for execution of the method according to the present invention when the computer program runs on a computer. Accordingly, the present invention is implemented by a digital storage medium including a computer program having program commands suitable for executing the method according to the present invention.

DETAILED DESCRIPTION

Figure 1:
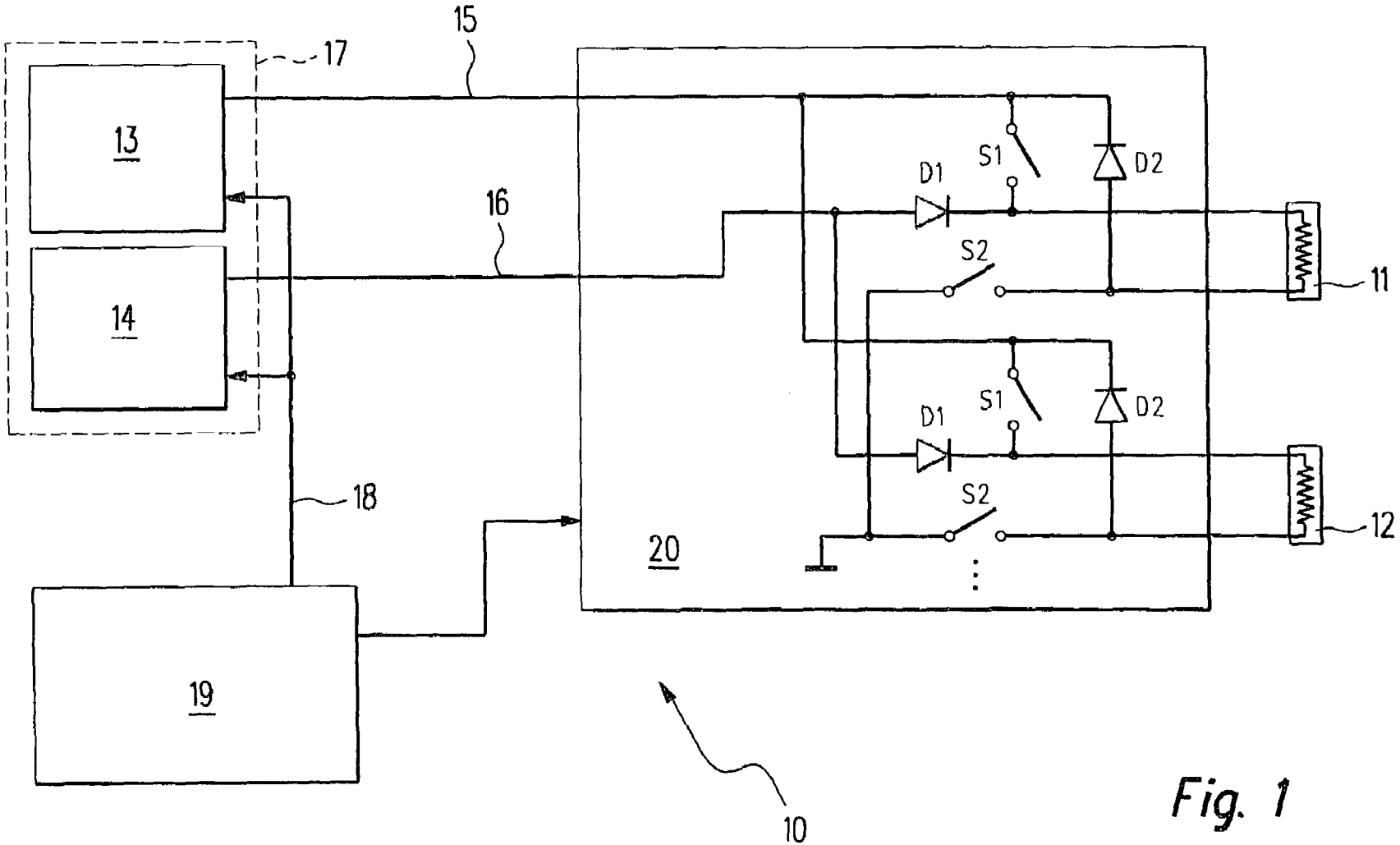
FIG. 1 shows a schematic block diagram of an exemplary embodiment of a device according to the present invention for controlling at least two electromagnetic valves of an internal combustion engine.

FIG. 1 shows a device 10 for controlling at least two electromagnetic valves 11, 12. Electromagnetic valves 11, 12 are provided for use in an internal combustion engine in a motor vehicle in particular. For example, electromagnetic valves 11, 12 may be provided in conjunction with an electrohydraulic valve control for the intake and exhaust valves of the internal combustion engine. In this case, a hydraulic system is controlled via electromagnetic valves 11, 12, the intake and exhaust valves of the internal combustion engine being able to be opened and closed using the hydraulic system.

It is pointed out here explicitly that device 10 may be used not only for two valves 11, 12 depicted here, but may also be used for any number of valves through appropriate expansions. It is thus possible to have a total of 32 solenoid valves for controlling the intake and exhaust valves of the internal combustion engine in the case of an engine having four cylinders.

Two d.c. converters 13, 14, which together form a converter 17, are provided for supplying power to valves 11, 12. Both d.c. converters 13, 14 and thus converter 17 include control means and/or regulating means for maintaining the generated output voltages at a predetermined setpoint level.

D.c. converter 13 is suitable for generating a booster current on an electric line 15. Accordingly, d.c. converter 14 is suitable for generating a holding current on an electric line 16. The booster current is greater than the holding current.

An output stage 20, which controls the current flow across valves 11, 12, is provided between d.c. converters 13, 14 and valves 11, 12. This control takes place via a control unit 19. The function of output stage 20, its control, and the generated current flow across valve 11 is explained in greater detail below in connection with FIG. 2. The explanation given there also applies accordingly to the current flow across valve 12 and the current flow across any additional valve.

Figure 2:
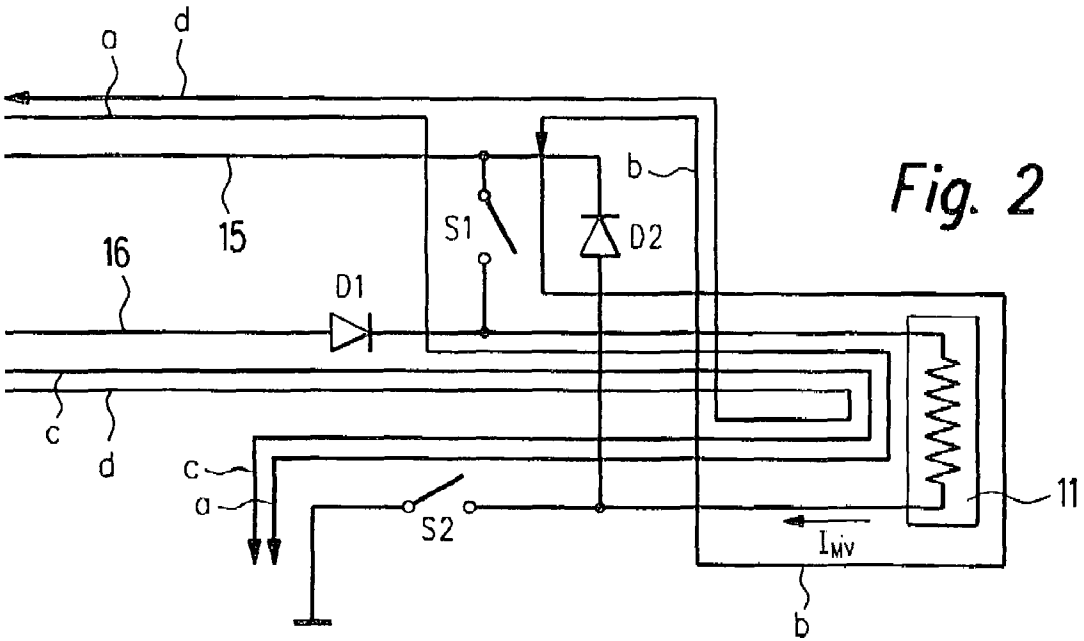
FIG. 2 shows a schematic wiring diagram for one of the electromagnetic valves with the current flow in four successive time ranges.

FIG. 2 shows lines 15, 16 coming from two d.c. converters 13, 14. Line 16 is connected via a diode D1, which is connected in the flow direction, to one of the two terminals of electromagnetic valve 11. The other terminal of electromagnetic valve 11 is connected via a diode D2, which is also connected in the flow direction, to line 15. The cathodes of both diodes D1, D2 are interconnected via a switch S1. The anode of diode D2 is connected to ground via a switch S2.

Depending on the switch positions of two switches S1, S2, there is a different current flow across valve 11. Four different switch positions resulting in four different current flows in four successive time ranges a, b, c, d may be set using two switches S1, S2. Control unit 19 as already mentioned controls the positions of two switches S1, S2.

Figure 3:
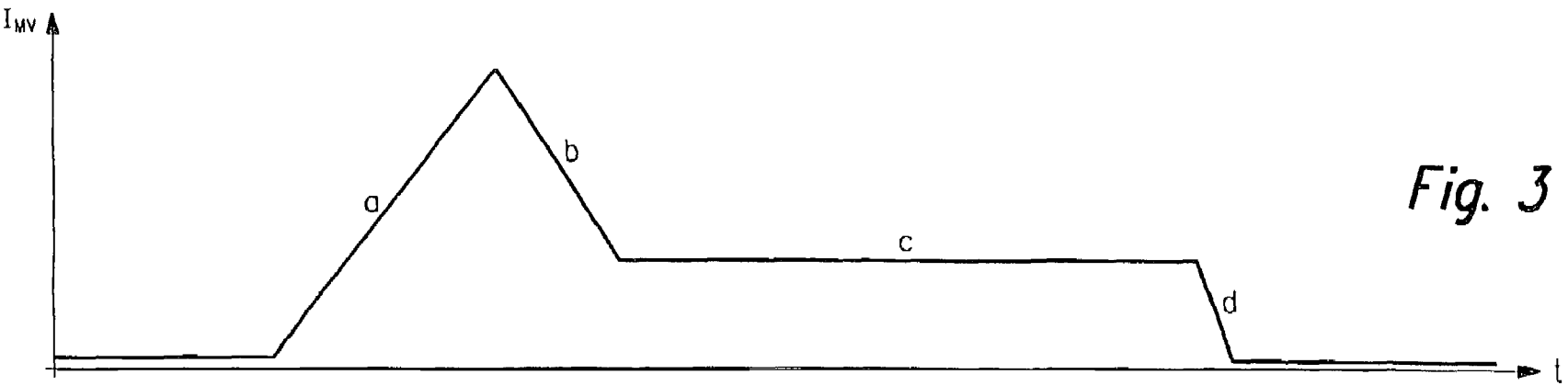
FIG. 3 shows a schematic time chart of the current across one of the electromagnetic valves in the four time ranges.

FIG. 3 shows current $I_{MV}$ across electromagnetic valve 11 as a function of time. In particular, FIG. 3 shows four time ranges a, b, c, d resulting from the four adjustable switch positions of two switches S1, S2.

In first time range a, both switches S1, S2 are closed. This yields current flow a, as shown in FIG. 2 and designated accordingly as "a." The booster current generated by d.c. converter 13 flows across valve 11. This current $I_{MV}$ increases to a final value according to FIG. 3 and is provided to adjust valve 11 into a preselected end position in any case.

In second time range b, which follows time range a, switch S1 is closed and switch S2 is opened. This yields a current flow as shown in FIG. 2 and designated accordingly as "b." This current flow is known as free-running. This means that at least a portion of the electric energy contained in electromagnetic valve 11 is dissipated via this free-running state. Accordingly, current $I_{MV}$ declines in time range b according to FIG. 3.

Switch S1 is opened in time range c and switch S2 is closed. This yields a current flow like that shown in FIG. 2, where it is designated accordingly as "c." The holding current generated by d.c. converter 14 in time range c is sent to valve 11. This holding current is selected so that the end position reached by valve 11 on the basis of the booster current does not change.

Both switches S1, S2 are opened in time range d, which follows time range c. This yields a current flow like that shown in FIG. 2 and designated accordingly as "d." This current flow represents quenching of electromagnetic valve 11. This means that the energy in electromagnetic valve 11 is dissipated completely to 0. Current $I_{MV}$ then issuing from valve 11 flows across diode D2 to d.c. converter 13 in time range d.

Figures 4A, 4B, 4C:
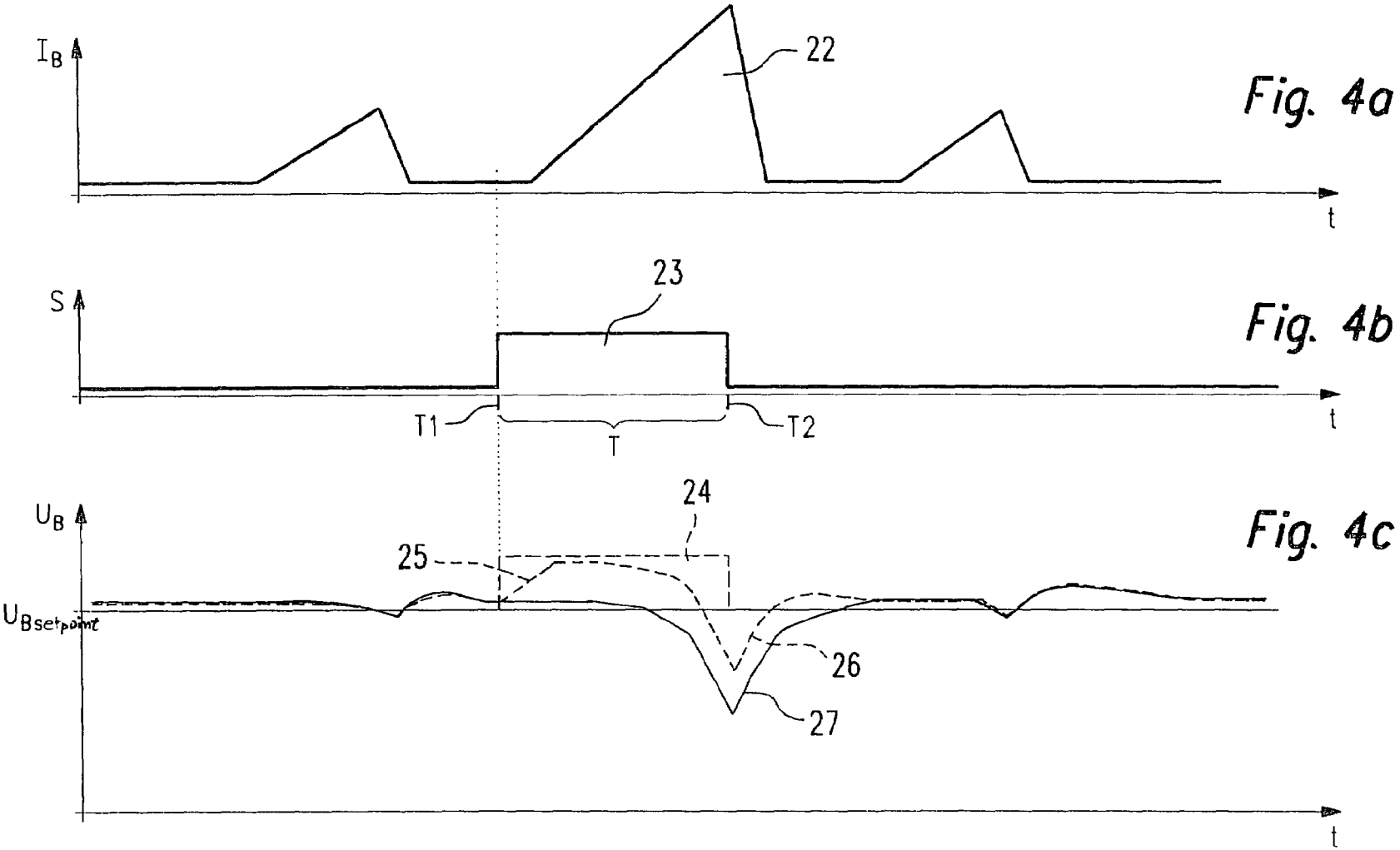
FIGS. 4*a*-4*c* show three schematic time charts of currents and voltages across, or at, the electromagnetic valves.

FIG. 4*a* shows booster current $I_B$ for connected valves 11, 12 generated by d.c. converter 13, plotted as a function of time t.

On the basis of two or more valves 11, 12 present here, it is possible for the booster currents of time ranges a of two or even more valves 11, 12 to overlap. Such overlap together with the resulting high booster current is designated by reference numeral 22 in FIG. 4*a*.

High booster current 22 results in d.c. converter 13 being exposed to very high loads. The following is provided for better processing of these loads:

Control unit 19 is connected to converter 17 via line 18, in particular to d.c. converter 13, which is responsible for the booster current. Control unit 19 determines when a high load has occurred due to overlapping booster currents. Control unit 19 is able to derive this from the provided triggerings of switches S1, S2 of output stage 20.

Before a high load occurs, control unit 19 indicates the imminent high load to converter 17, in particular d.c. converter 13. This is accomplished with the help of a signal S, which is sent from control unit 19 via line 18 to converter 17.

FIG. 4*b* shows signal S plotted as a function of time t. It is apparent here that signal S is present during a period of time T, which extends from a point in time T1 to a point in time T2. This is designated by reference numeral 23 in FIG. 4*b*. Period of time T corresponds approximately to the period of time during which high booster current 22 from FIG. 4 is present.

FIG. 4*c* shows output voltage $U_B$ of d.c. converter 13 plotted as a function of time. As mentioned previously, this output voltage $U_B$ is controlled and/or regulated to a predetermined setpoint value. The setpoint value is designated as $U_{Bsetpoint}$ in FIG. 4*c*. Control and/or regulation of d.c. converter 13 is designed, for example, so that output voltage $U_B$ of d.c. converter 13 varies in a tolerance range of ±10% around setpoint value $U_{BS}$.

As FIG. 4*c* shows, setpoint value $U_{BS}$ of output voltage $U_B$ of d.c. converter 13 is raised during period of time T. This is indicated with a dashed line in FIG. 4*c* and labeled as 24.

As already mentioned, period of time T of FIG. 4*b* begins shortly before the rise in high booster current 22 in FIG. 4*a* after time T1. As a result, setpoint value $U_{Bsetpoint}$ also increases just prior to the rise in high booster current 22. This increase in setpoint value $U_{Bsetpoint}$ also yields an increase in output voltage $U_B$ of d.c. converter 13, which is shown by a dashed line in FIG. 4*c* and is designated by reference numeral 25.

After the point in time when booster current $I_B$ (which is designated as 22 in FIG. 4*a*) rises, d.c. converter 13 thus supplies an increased output voltage $U_B$ (designated as 25). This yields the result that d.c. converter 13 is able to better process the high load associated with the rise in booster current $I_B$.

In particular, increased setpoint value $U_{Bsetpoint}$ and resulting increased output voltage $U_B$ result in the dip in this output voltage $U_B$ due to high booster current $I_B$ being lower than would be the case without the aforementioned increase. This is shown in FIG. 4*c* on the basis of the curves designated by reference numerals 26, 27. The curve resulting from the increase in setpoint value $U_{Bsetpoint}$ is indicated by a dashed line and is designated by reference numeral 26, while the curve that would result without the above-described increase in setpoint value $U_{Bsetpoint}$ is designated by reference numeral 27.

Due to the smaller dip in output voltage $U_B$ (designated as 26 in FIG. 4*c*), it is possible to provide d.c. converter 13 with a lower output capacitance than would be necessary without the increase in setpoint value $U_{Bsetpoint}$. It is likewise possible for the control and/or regulating means contained in converter 17 to take preventive measures on the basis of signal S, namely in particular on the basis of the rise in signal S at the beginning of period of time T and to do so as a preventive measure even before the occurrence of a system deviation to counteract the system deviation that would result on the basis of the high booster current. In particular, the control and/or regulating means may increase the output power of d.c. converter 13 as a preventive measure.

Other emergency functions may be implemented via line 18 as follows:

For example, if d.c. converter 14 fails and if this is detected by control unit 19 via measures not described more closely in the present case, control unit 19 may control and/or regulate remaining d.c. converter 13 so that it assumes the function of d.c. converter 14 and additionally generates the holding current. For example, the output voltage of d.c. converter 13 may be pulsed to thereby generate a corresponding holding current.

In the inverse case, control unit 19 may control and/or regulate d.c. converter 14 so that it generates not only the holding current but also the booster current. In particular, control unit 19 may increase the setpoint value of the output voltage of d.c. converter 14. In addition, it may be advisable for control unit 19 to trigger switches S1, S2 at an earlier point in time for generating the booster current to thus compensate for possible deterioration of the tightening dynamics of valves 11, 12.

What is claimed is:

1. A method for regulating a d.c. converter for at least two electromagnetic valves of an internal combustion engine, the method comprising:

supplying each of the at least two electromagnetic valves with a current that is generated by the d.c. converter;

determining when a total current supplied to the at least two electromagnetic valves constitutes a high load for the d.c. converter; and if a high load is determined, adapting the d.c. converter for processing of the high load;

wherein the current supplied to each of the at least two electromagnetic valves is determined as a function of a triggering provided for an output stage upstream from the at least two electromagnetic valves.

2. The method of claim 1, wherein the high load for the d.c. converter is derived from overlapping currents of the at least two electromagnetic valves.

3. A method for regulating a d.c. converter for at least two electromagnetic valves of an internal combustion engine, the method comprising:

supplying each of the at least two electromagnetic valves with a current that is generated by the d.c. converter;

determining when a total current supplied to the at least two electromagnetic valves constitutes a high load for the d.c. converter; and if a high load is determined, adapting the d.c. converter for processing of the high load;

wherein adaptation of the d.c. converter includes increasing an output voltage of the d.c. converter in the case of a high load.

4. A method for regulating a d.c. converter for at least two electromagnetic valves of an internal combustion engine, the method comprising:

supplying each of the at least two electromagnetic valves with a current that is generated by the d.c. converter;

determining when a total current supplied to the at least two electromagnetic valves constitutes a high load for the d.c. converter; and if a high load is determined, adapting the d.c. converter for processing of the high load;

wherein adaptation of the d.c. converter includes increasing an output voltage of the d.c. converter in the case of a high load, and wherein the output voltage is regulated with reference to a setpoint value, and wherein the setpoint value is increased.

5. A method for regulating a d.c. converter for at least two electromagnetic valves of an internal combustion engine, the method comprising:

supplying each of the at least two electromagnetic valves with a current that is generated by the d.c. converter;

determining when a total current supplied to the at least two electromagnetic valves constitutes a high load for the d.c. converter; and if a high load is determined, adapting the d.c. converter for processing of the high load;

wherein an output power of the d.c. converter is increased in the case of a high load.

6. The method of claim 5, wherein the increase in the output voltage is terminated upon termination of the high load state.

7. A method for regulating a d.c. converter for at least two electromagnetic valves of an internal combustion engine, the method comprising:

supplying each of the at least two electromagnetic valves with a current that is generated by the d.c. converter;

determining when a total current supplied to the at least two electromagnetic valves constitutes a high load for the d.c. converter; and if a high load is determined, adapting the d.c. converter for processing of the high load;

wherein an increase in an output voltage of the d.c. converter is performed prior to an occurrence of the high load.

8. A computer-readable storage medium for storing computer program having instructions for controlling, when the program is executed by a computer, a method comprising:

supplying each of the at least two electromagnetic valves with a current that is generated by the d.c. converter;

determining when a total current supplied to the at least two electromagnetic valves constitutes a high load for the d.c. converter; and if a high load is determined, adapting the d.c. converter for processing of the high load;

wherein the current supplied to each of the at least two electromagnetic valves is determined as a function of a triggering provided for an output stage upstream from the at least two electromagnetic valves.

9. A device for regulating a d.c. converter for at least two electromagnetic valves of an internal combustion engine in a motor vehicle, a current generated by the d.c. converter being supplied to each of the at least two electromagnetic valves, the device comprising:

a control unit configured to determine when a total current supplied to the at least two electromagnetic valves represents a high load for the d.c. converter, wherein the control unit regulates the d.c. converter for optimal processing of the high load, and wherein the current supplied to each of the at least two electromagnetic valves is determined as a function of a triggering provided for an output stage upstream from the at least two electromagnetic valves.

* * * * *